United States Patent [19]

Rivard

[11] Patent Number: 4,768,297

[45] Date of Patent: Sep. 6, 1988

[54] TRENCHING WHEEL, MORE ESPECIALLY FOR DIGGING TRENCHES

[75] Inventor: Daniel Rivard, Daumeray, France

[73] Assignee: Ets. Rivard S.A., Daumeray, France

[21] Appl. No.: 59,816

[22] Filed: Jun. 9, 1987

[30] Foreign Application Priority Data

Jun. 11, 1986 [FR] France ..... 86 08450

[51] Int. Cl.[4] ..... E02F 3/24; E02F 5/08

[52] U.S. Cl. ..... 37/91; 37/189; 37/141 T

[58] Field of Search ..... 37/189, 190, 94, 95, 37/96, 97, 80 R, 141 R, 141 T, 91, 142 A, 142 R

[56] References Cited

U.S. PATENT DOCUMENTS

| | | | |
|---|---|---|---|
| 4,265,037 | 5/1981 | Lamouric | 37/189 X |
| 4,335,532 | 6/1982 | Hohn et al. | 37/142 R |
| 4,413,432 | 11/1983 | Bierwith | 37/142 A |

*Primary Examiner*—William Pieprz
*Assistant Examiner*—Kim L. Asher
*Attorney, Agent, or Firm*—Fisher, Christen & Sabol

[57] ABSTRACT

A trenching wheel more especially for digging trenches, of the type in which the tools are mounted on ring portions removably fixed to the periphery of said wheel. The arrangement for fixing each ring portion to the periphery of said wheel include:

a first assembly of two end faces provided respectively at the ends of said ring portion a second assembly of two abutment faces fixed to the periphery of said wheel and orthogonal to the plane thereof; and a wedge shaped key insertable from outside the periphery of said wheel inwardly thereof, between an end face of said first assembly and an abutment face of said second assembly for applying the other of said end faces of said first assembly under pressure against the other of said abutment faces of said second assembly.

8 Claims, 2 Drawing Sheets

TRENCHING WHEEL, MORE ESPECIALLY FOR DIGGING TRENCHES

BACKGROUND OF THE INVENTION

It is known that, particularly for laying cables or pipes underground, it is necessary to open trenches in the ground. For that, trenching machines include a motor driven chassis, for example a tractor, on which is mounted a trenching wheel able to be driven in rotation and having at its periphery a plurality of tools for digging the ground.

The tools are either fixed directly to the periphery of the wheel, generally by welding, or are fixed to removable ring portions evenly spaced apart about the periphery of the wheel, said portions being bolted to said wheel.

In the first case, it is impossible to replace a broken tool or change the type of tool for others, as a function of the nature of the ground met with. It is then necessary to change the whole wheel.

It the second case, although the portions carrying the tools may be changed, it requires, because of the use of bolts, careful handling (screwing, unscrewing of the bolts, cooperation of the threads with each other. . . ) often carried out under difficult conditions, requiring a considerable time for carrying out the replacement.

The present invention overcomes these drawbacks and provides a trenching wheel, in which the fitting and removal of the removable ring portions carrying the tools can be carried out easily and rapidly.

SUMMARY OF THE INVENTION

For this, the trenching wheel of the invention, of the type in which the tools are mounted on ring portions removably fixed to the periphery of said wheel, is remarkable in that the means for fixing each ring portion to the periphery of said wheel include:

a first assembly of two end faces provided respectively at the ends of said ring portion a second assembly of two abutment faces fixed to the periphery of said wheel and orthogonal to the plane thereof; and a wedge shaped key insertable from outside the periphery of said wheel inwardly therof, between an end face of said first assembly and an abutment face of said second assembly for applying the other of said end faces of said first assembly under pressure against the other of said abutment faces of said second assembly.

Thus, with the invention, after placing said ring portion carrying the tools on the periphery of said wheel between the two abutment faces of said second assembly, said portion is fixed by inserting the key into the space defined between one of the end faces of the first assembly and one of the abutment faces of the second assembly causing the engagement under pressure of the other end face of said first assembly against the other abutment face of said second assembly, so as to lock said ring portion by jamming.

According to another advantageous characteristic of the invention, the two end faces of the first assembly are slanted so as to converge towards the convexity of said ring portion. Advantageously, the slants of the two end faces of said first assembly are symmetrically identical with respect to a perpendicular plane median to said ring portion.

According to another characteristic of the invention, the two abutment faces of the second assembly are slanted so as to converge outwardly of the periphery of the wheel, one of the abutment faces of the second assembly having a slant corresponding to that of one of the end faces of the first assembly, whereas the other abutment face of said second assembly has a slant different from that of the other end face of said first assembly, the space separating the two latter faces widening outwardly of the periphery of the wheel.

In a preferred embodiment, the two abutment faces of the second assembly each belong to wedges integral with said periphery.

So as to provide locking of the ring portion by jamming between said two wedges, said key has two lateral slanting sides, one corresponding with that of the cooperating end face of said first assembly and the other with that of the cooperating abutment face of the second assembly.

In order to increase the reliability of fixing, once said key has been inserted in the space defined between said faces of different slants, it is held in position on said periphery by a retaining means.

According to another characteristic of the invention, so as to be able to readily remove said ring portion carrying the tools for example for maintaining them or for changing a portion having another type of tool, an opening is formed in said key in which an element may be introduced for ejecting it out of the periphery of the wheel.

Said tools disposed on each removable ring portion fitted to the periphery of the wheel are either rock tools or earth tools. Advantageously, when the ground to be dug is formed of a combination of rocks and earth, said tools disposed on each removable ring portion are both rock tools and earth tools.

The invention also provides a trenching wheel remarkable in that said portions carrying the tools are mounted in an annular groove formed at the periphery of the wheel, each wedge including one of said abutment faces of said second assembly being mounted in said groove.

Finally, the invention provides a trenching machine remarkable in that has at least one trenching wheel such as defined above.

BRIEF DESCRIPTION OF THE DRAWINGS

The Figures of the accompanying drawings will better show how the invention may be constructed. Identical references designate similar elements.

DESCRIPTION OF THE PREFERRED EMBODIMENTS

The trenching wheel, of the invention, generally mounted on a tractor by means of swinging arms not shown, is intended for digging trenches in the ground. It can be driven in rotation by a drive means known per se but not shown.

Figure 1:
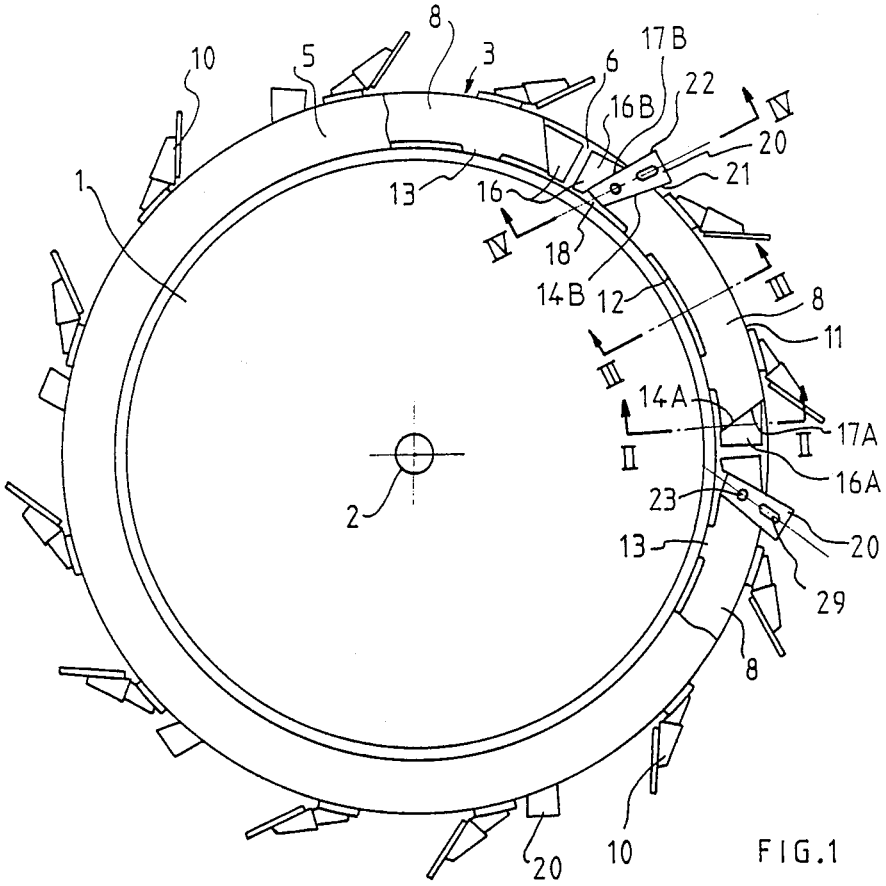
FIG. 1 is a front view with parts cut away of a trenching wheel of the invention.
Figure 2:
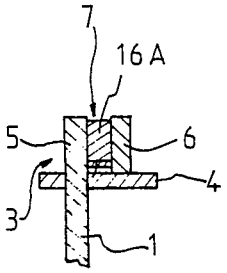
FIGS. 2, 3 and 4 show sectional views of the trenching wheel through sectional planes respectively II—II, III—III and IV—IV of FIG. 1.
Figure 3:
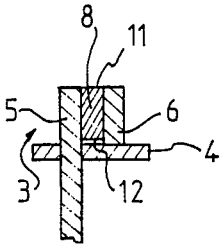

This trenching wheel is formed of a circular substantially flat wheel disk 1 mounted for rotation about its axis 2. As can be better seen in FIGS. 2 to 4, at the periphery 3 of wheel disk 1 there is disposed, parallel and coaxial therewith, a parallel ring 6 integrally secured to said disk by means of a lateral ring 4 welded to one face of wheel disk 1. An annular groove 7 is then defined between annulus 6 and the part 5 of the face of wheel disk 1 in correspondance with the parallel ring 6, the ring 4 forming the bottom of groove 7.

Thus, removable ring portions 8, preferably identical and spaced evenly apart over the periphery 3 of wheels 1, can be fitted in the annular groove 7. Tools 10, for digging the ground, are mounted on the convex face 11 of each of the ring portions 8. On the concave face 12 of each of the ring portions 8, bearing surfaces 13 are provided for engagement against the bottom of groove 7 during the assembly of each portion 8.

Each removable ring portion 8 has two end faces 14*a* and 14*b* situated respectively at the ends of each of the portions. These two end faces 14*a* and 14*b*, defining a first assembly, are slanted so as to converge towards the convexity of each portion, that is to say outwardly of the wheel. In addition, these two faces 14*a* and 14*b* are orthogonal to the plane of the wheel and, advantageously, have a slant symmetrically identical with respect to the perpendicular plane median to each portion.

The width of these removable ring portions 8 is determined so that they fit correctly between the parallel ring 6 and the part 5 of wheel disk 1 defining the sides of grooves 7.

In grooves 7, wedges 16 are fitted by welding. More precisely, these wedges 16 are positioned in pairs so that a ring portion 8 may be inserted between two wedges of the same pair, in this case 16*a* and 16*b*. The length of the arc of a circle separating the two wedges is greater than that of the corresponding ring portion 8.

As can be seen in FIGS. 1 to 5, each pair of wedges 16*a* and 16*b*, disposed each on one side of ring portion 8, has two slanting abutment faces, respectively 17*a* and 17*b*.

These two slanting faces 17*a* and 17*b*, defining a second assembly, are orthogonal to the plane of the wheel and converge towards the convexity of the wheel. The point of convergence of the slanting abutment faces 17*a* and 17*b* is further away from the wheel than that of the end faces 14*a* and 14*b*. In fact, the slant of face 14*a* of each ring portion 8 is identical to that of the face 17*a* of the corresponding wedge 16*a*, whereas the slant of the face 14*b* of each ring portion 8 is different from that of the face 17*b* of the corresponding wedge 16*b*. A space 18 is thus created between the face 14*b* of each portion 8 and the face 17*b* of the corresponding wedge 16*b*. This space 18 widens from the bottom of groove 7 outwardly thereof.

In accordance with the invention, each removable ring portion 8 is fixed in groove 7 of said wheel by engagement of the first assembly of end faces 14*a* and 14*b* of a ring portion in the second assembly of abutment faces 17*a* and 17*b* of a corresponding wedge pair and by the interpositioning of a key 20 in said above mentioned space 18.

Key 20 has then two lateral sides 21 and 22, one of which, 21, has a slant identical to that of face 14*b* of ring portion 8 and the other of which, 22, has a slant identical to that of the face 17*b* of wedge 16*b*.

Figure 5:
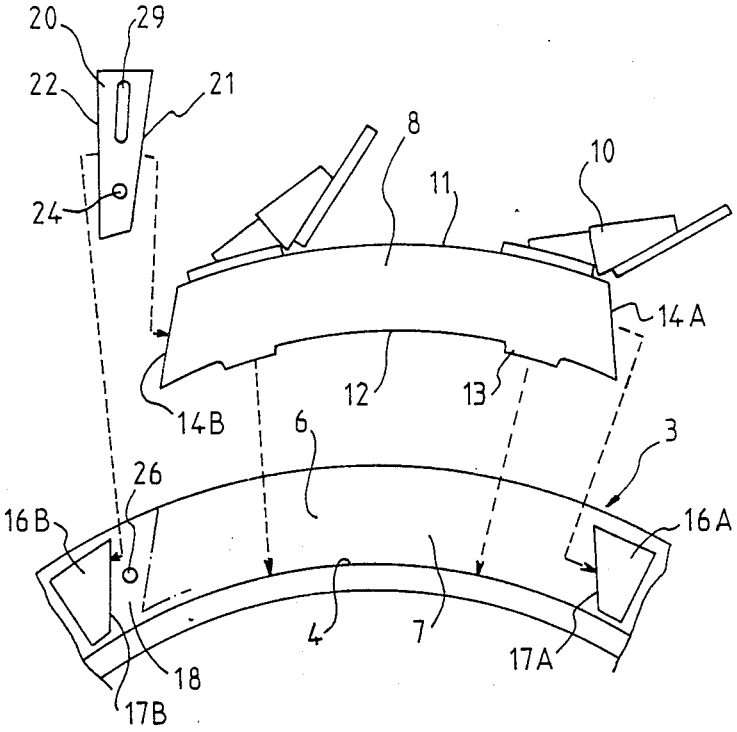
FIG. 5 is an enlarged exploded view of the main elements forming a ring portion of the trenching wheel, of the invention before assembly.

Thus, as can be seen from FIG. 5, the ring portion 8 is assembled and fixed as follows: portion 8 is fitted by its concave face 12 against the parallel ring 6 and the part 5 of the wheel disk defining the sides of grooves 7 until the bearing surfaces 13 rest on the ring 4 integral with wheel disk 1, and corresponding to the bottom of groove 7.

The ring portion 8 is moved towards wedge 16*a* so that the face 14*a* and face 17*a* of identical slant are disposed substantially one opposite the other. Insertion of key 20 is thus facilitated since space 18 separating faces 14*b* and 17*b* is almost maximum.

Key 20 is then inserted in the space 18 so that its lateral sides 21 and 22 engage respectively with the faces 14*b* and 17*b*. Then key 20 is forcibly driven into space 18 by means of a tool such as a hammer, which results in moving the ring portion 8 against wedge 16*a* integral with at least one side of the groove. Thus, face 14*a* is applied under pressure against face 17*a*.

The ring portion 8 is locked between the two wedges 16*a* and 16*b* by jamming by means of the two assemblies of faces slanted appropriately and the key.

Figure 4:
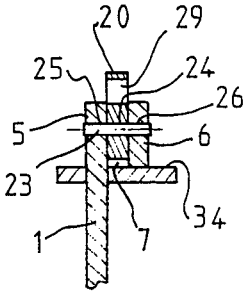

In addition, in order to maintain each ring portion 8 in the locked position, and although the direction of the forces exerted by the ground on the tools, during operation of the trenching wheel, tend to apply said portions against the bottom of the groove, so to keep this position, a retaining member 23 connects the key to the sides of the groove. More precisely, as can be seen in FIG. 4, an orifice 24 pierced in each of the keys comes opposite coaxial orifices 25 and 26, some, 25, formed respectively in part 5 of wheel disk 1 and the others, 26, in the parallel ring 6.

When the key is correctly fitted into space 18, orifices 24, 25 and 26 are substantially coaxial, and the retaining member 23, such as a pin, is then driven into its orifices so as to hold and lock said key in position. Each key is then held in its position.

The trenching wheel, is then ready to operate.

In order to be able to readily remove the ring portions 8 carrying the tools, each key is provided with an opening 29 for inserting therein an element for ejecting said key. Before removal of a ring portion 8, for example for replacing it by another portion, it is necessary to remove the corresponding pin 23.

Then, by means of a drift fitting into the opening 29, for example an oblong hole, formed in the key, this latter is ejected outwardly of the groove thus releasing said ring portion 8 which may then be removed and replaced by another.

The tools 10 fixed to the convex face 11 of each of the removable ring portions 8 are either knives 31 for digging in soft ground (earth, sand, . . . ), or picks 32 for digging in hard ground, (stones, rocks . . . ).

Figure 6:
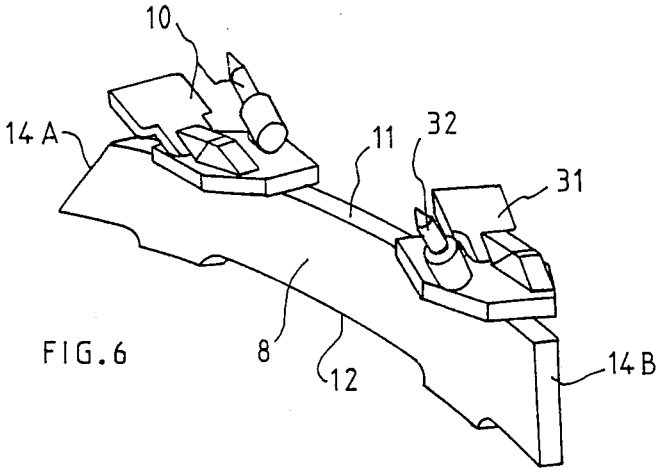
FIG. 6 shows in perspective one of the removable ring portions carrying rock and earth tools.

However, in another aspect of the invention, in the case of composite ground formed for example of rocks and earth, it is particularly advantageous (FIG. 6) to fix on the convex face 12 of each of the ring portions 8 knives 31 and picks 32 disposed alternately behind each other and on each side of the plane of the wheel.

In a variant of construction, each wedge could include a slanting abutment face 17*a* on which is pressed the slanting end face 14*a* of a first ring portion 8 and a slanting abutment face 17*b*, opposite the preceding one, on which the lateral side 22 of the key is pressed for jamming a second ring portion contiguous with the first ring portion.

What is claimed is:

1. A trenching wheel in which the tools are mounted on a plurality of ring portions removably fixed to the periphery of said wheel, wherein:

each ring portion (8) has a first (14A) abutment face and a second (14B) abutment face, respectively provided at the ends of said ring portion (8);

there are provided pairs of stops (16A, 16B) fast with said wheel and having respectively third (17A) and fourth (17B) abutment faces, said third and fourth abutment faces of said pairs of stops are slanted so as to converge outwardly of the periphery of the wheel, said third abutment face having a slant corresponding to that of said first abutment face of said ring portion, whereas said fourth abutment face has a slant different from that of said second abutment face, and the space between said second and fourth abutment faces widening outwardly of the periphery of the wheel; and for each ring portion (8), there is provided a wedge (20) insertable from outside of the periphery of said wheel inwardly thereof between said second (14B) and fourth (17B) abutment faces for urging said first abutment face (14A) against said third abutment face (17A) in order to removably fix said ring portion to said wheel.

2. The trenching wheel as claimed in claim 1 wherein said first and second abutment faces of said ring portion are slanted so as to converge towards the convexity of said ring portion.

3. The trenching wheel as claimed in claim 1 wherein the slants of said first and second abutment faces of said ring portion are symmetrically with respect to a perpendicular plane median to said ring portion.

4. The trenching wheel as claimed in claim 1 wherein said wedge has two lateral slanting sides, one corresponding with that of said second abutment face of said ring portion and the other with that of said fourth abutment face of said stops.

5. The trenching wheel as claimed in claim 1 wherein once said wedge has been inserted in the space defined between said second and fourth abutment faces, it is held in position on said periphery by a retaining means.

6. The trenching wheel as claimed in claim 1 wherein an opening is formed in said wedge in which an element may be introduced for ejecting said wedge out of the periphery so as to be able to remove said ring portion carrying the tools.

7. The trenching wheel as claimed in claim 1 wherein said ring portions carrying the tools are mounted in an annular groove formed at the periphery of the wheel, each wedge being mounted securely in said groove.

8. A trenching machine including at least one trenching wheel as defined in claim 1.

* * * * *